US010806238B2

(12) United States Patent
Sears et al.

(10) Patent No.: US 10,806,238 B2
(45) Date of Patent: Oct. 20, 2020

(54) BACKPACK WITH DYNAMIC FLEXIBLE HIP BELT

(71) Applicant: Samsonite IP Holdings S.a r.l., Luxembourg (LU)

(72) Inventors: John Bemis Sears, Salt Lake City, UT (US); Matthew Halloran Connors, Salt Lake City, UT (US)

(73) Assignee: Samsonite IP Holdings S.a.r.l., Luxembourg (LU)

( * ) Notice: Subject to any disclaimer, the term of this patent is extended or adjusted under 35 U.S.C. 154(b) by 0 days.

(21) Appl. No.: 15/996,214

(22) Filed: Jun. 1, 2018

(65) Prior Publication Data

US 2019/0350347 A1 Nov. 21, 2019

Related U.S. Application Data

(60) Provisional application No. 62/671,961, filed on May 15, 2018.

(51) Int. Cl.
*A45F 3/08* (2006.01)
*A45F 3/04* (2006.01)

(52) U.S. Cl.
CPC ..... *A45F 3/08* (2013.01); *A45F 3/047* (2013.01); *A45F 2003/045* (2013.01)

(58) Field of Classification Search
CPC ..... A45F 3/08; A45F 3/047; A45F 2003/045; A45F 3/04
USPC ..... 224/663
See application file for complete search history.

(56) References Cited

U.S. PATENT DOCUMENTS

| | | | | |
|---|---|---|---|---|
| 4,015,759 | A | 4/1977 | Dreissigacker et al. | |
| 4,099,657 | A | 7/1978 | Zufich | |
| 4,504,002 | A | 3/1985 | Hall | |
| 4,676,418 | A * | 6/1987 | Lowe | A45F 3/08 224/262 |
| 4,982,884 | A | 1/1991 | Wise | |
| 5,090,604 | A * | 2/1992 | Howe | A45F 3/04 224/641 |

(Continued)

FOREIGN PATENT DOCUMENTS

| | | |
|---|---|---|
| AU | 765141 B2 | 9/2003 |
| CA | 1044197 A | 12/1978 |

(Continued)

OTHER PUBLICATIONS

EPO, "Extended European Search Report", App. No. 19174561.1, dated Sep. 30, 2019, 8 pages.

*Primary Examiner* — Nathan J Newhouse
*Assistant Examiner* — Lester L Vanterpool
(74) *Attorney, Agent, or Firm* — Dorsey & Whitney LLP

(57) ABSTRACT

A backpack including a flexible hip belt assembly is provided. The backpack may include a frame assembly defining a lower portion, a hip belt including a central portion and a lower portion with opposing first and second arms extending from the central portion. The lower portion of the hip belt and the lower portion of the frame assembly may be securely coupled together to support a substantially vertical load. A resilient member may couple the hip belt to the frame assembly. The resilient member may expand or contract as the hip belt and frame assembly move relative to one another to reduce the forces applied to the hip belt by the non-vertical movement of the frame assembly.

18 Claims, 8 Drawing Sheets

(56) References Cited

U.S. PATENT DOCUMENTS 5,114,059 A 5/1992 Thatcher
5,429,287 A 7/1995 Frano
5,503,314 A * 4/1996 Fiscus ..... A45F 3/08 224/262
5,564,612 A * 10/1996 Gregory ..... A45F 3/08 224/633
5,742,988 A 4/1998 Swetish
5,904,282 A 5/1999 Gleason
5,954,250 A 9/1999 Hall et al.
5,954,253 A * 9/1999 Swetish ..... A45F 3/08 224/628
5,971,244 A * 10/1999 Jaeger ..... A45F 3/08 224/632
6,015,076 A 1/2000 Pennington
6,179,188 B1 1/2001 Gleason
6,607,108 B2 8/2003 Mydans
6,840,419 B2 1/2005 Penny et al.
6,886,727 B2 5/2005 Moore
7,287,677 B2 * 10/2007 Reid ..... A45F 3/047 224/628
8,020,738 B2 * 9/2011 Storey ..... A45F 3/10 224/148.7
8,066,164 B2 11/2011 Gregory
8,172,117 B2 * 5/2012 Maggi ..... A45F 3/047 224/263
8,360,289 B2 1/2013 Thibadeau, Jr. et al.
9,113,697 B2 * 8/2015 Brensinger ..... A45F 3/04
9,200,871 B2 * 12/2015 Hexels ..... A45F 3/06
9,462,875 B2 * 10/2016 Paduano ..... A45F 3/047
2002/0108982 A1 * 8/2002 Mydans ..... A45F 3/04 224/641
2005/0092802 A1 5/2005 Maley
2006/0151559 A1 * 7/2006 Gravseth ..... A45F 3/04 224/637
2006/0163305 A1 7/2006 Tong
2006/0191969 A1 * 8/2006 Goulding ..... A45F 3/08 224/635
2009/0131355 A1 * 5/2009 Bot ..... C12N 15/111 514/44 R
2010/0243693 A1 * 9/2010 Terry ..... A45F 3/08 224/633
2010/0243694 A1 * 9/2010 Oddou ..... A45F 3/04 224/633
2013/0240590 A1 9/2013 Montgomery
2014/0014700 A1 1/2014 Gill et al.
2014/0027481 A1 1/2014 Schultz et al.
2017/0049218 A1 2/2017 Moncreiff
2017/0325572 A1 11/2017 Reid et al.

FOREIGN PATENT DOCUMENTS

EP 0104538 B1 1/1988
EP 0628265 A1 12/1994
EP 0873065 B1 6/1999
WO 9749312 A1 12/1997

* cited by examiner

BACKPACK WITH DYNAMIC FLEXIBLE HIP BELT

CROSS-REFERENCE TO RELATED APPLICATIONS

This application claims the benefit of priority pursuant to 35 U.S.C. § 119(e) of U.S. Provisional Application No. 62/671,961, filed 15 May 2018, and entitled "Backpack with dynamic flexible hip belt," which is hereby incorporated by reference in its entirety for all purposes.

TECHNICAL FIELD

The technology described herein relates generally to backpacks and, more specifically, to hip belt assemblies for backpacks.

BACKGROUND

Backpacks have long been used to carry heavy, bulky loads. Various configurations of backpacks exist, including packs having external frames, internal frames, and those without frames. Regardless of the type of backpack, backpacks often include a hip belt attached to a lower portion of the sack to facilitate in distributing the weight of the load onto a wearer in a desirable manner. A hip belt transfers some of the load onto the hips and lumbar area of a wearer, and can reduce the load applied to the user's shoulders, thus allowing the wearer to carry a heavy load in relative comfort.

Typically, a hip belt is attached to a lower portion of the backpack, extending about the hips of the wearer. Many hip belts include padding to add comfort on the wearer's hip and back, and buckles in the front to secure the hip belt around the wearer's waist. Many hip belts are rigidly attached to the backpack causing the weight of the backpack to shift as a wearer moves. A shifting load may cause overloading to concentrated areas on the wearer, and cause discomfort.

More recently, certain hip belts have been configured with mechanical adjustments to facilitate the relative movement between the sack and the hip belt. However, many of these mechanical adjustments do not allow the hip belt to move sufficiently relative to the sack of the backpack given the wearer's movements. Thus, as the wearer moves, the load still tends to shift an undesirable amount relative to the wearer's hips. Further, such mechanical attachments of the hip belt may be bulky, complex, and difficult to manufacture.

It is therefore desirable to provide an improved hip belt assembly, and, more specifically, to provide a simple and resilient hip belt assembly that can conform to a wearer's movements while providing effective load distribution.

Documents that may be related to the present disclosure include AT180637 T, AU2705797 A, AU3900397 A, AU3507597 A, AU1969883 A, AU765141 B2, CA1044197 A, CA2861974 A1, CA2262641 A1, CA2258870 A1, CN106535705 A, CN1225559 A, DE10025154 A1, DE873065 T1, DE29723060 U1, DE19781908 T1, DE104538 T1, DE3375366 D1, DE69700254 D1, DE69700254 T2, EP3136903 A1, EP0873065 A1, EP0873065 B1, EP0104538 B1, EP0923325 A1, EP0628265 A1, GB2525662 A, GB2350286 B, IES71158 B2, IL105983 A, JPH078319 A, JP2000513255 A, MX2014008789 A, NZ335931 A, NZ201751 A, U.S. Pat. Nos. 6,015,076 A, 6,024,265 A, 5,090,604 A, 4,015,759 A, 5,429,287 A, 5,954,250 A, 4,504,002 A, 5,904,282 A, 5,449,102 A, 5,954,253 A, 4,099,657 A, 4,114,788 A, 4,154,381 A, 4,189,076 A, 5,742,988 A, 4,479,595 A, 5,564,612 A, 5,114,059 A, 6,276,584 B1, 6,179,188 B1, 8,360,289 B2, 8,066,164 B2, 6,840,419 B2, 6,886,727 B2, 6,607,108 B2, US20140027481 A1, US20170325572 A1, US20170049218 A1, US20130240590 A1, US20060163305 A1, US20050092802 A1, WO2013109872 A1, WO9806298 A1, WO2015166224 A1, WO9749312 A1, WO9742851 A1.

SUMMARY

The present disclosure provides a backpack with a flexible hip belt assembly, as described below and defined in the accompanying claims. The backpack may include a frame assembly supporting the structure of the backpack, including a sack for holding articles; a hip belt coupled to the backpack for distributing the weight of a load to a wearer, and one or more resilient panels resiliently coupling the hip belt to the frame assembly. The frame assembly may include a back panel assembly that interfaces with a wearer, a frame member coupled to the back panel assembly, and a support panel operably coupled to the frame member. The back panel assembly may include a back panel dividing the front and back of the backpack, and a suspension panel that is spaced away from the back panel.

Embodiments of the present disclosure may include a backpack. The backpack may include a frame assembly defining a lower portion, a load support assembly including a central portion, and a lower portion. The central portion may have opposing first and second arms extending from the central portion, and in one example extending from opposing lateral portions. The lower portion of the load support assembly and the lower portion of the frame assembly may be securely coupled together to support a substantially vertical load applied between the frame assembly and the load support assembly. At least one resilient member may couple the load support assembly to the frame assembly. Additionally or separately, the at least one resilient member may define opposing upper and lower edge portions, and opposing interior and exterior side edge portions. Additionally or separately, at least a part of the interior side edge portion of the at least one resilient member may be attached to the load support assembly. Additionally or separately, at least part of at least one of the upper edge portion and exterior side edge portion may be attached to the frame assembly. The at least one resilient member may expand or contract as the load support assembly and frame assembly move relative to one another to reduce the forces applied to the load support assembly by the non-vertical movement of the frame assembly.

Additionally or separately, the frame assembly may include a back panel assembly defining opposing first and second side edge portions. The frame assembly may also include a frame member disposed about a perimeter of the back panel assembly. The at least part of at least one of the upper edge portion and exterior side edge portion of the at least one resilient member may be attached to at least one of the back panel assembly and the frame member.

Additionally or separately, the back panel assembly may include a back panel defining opposing first and second side edge portions. The back panel assembly may also include a suspension panel coupled to at least an upper portion of the back panel and spaced apart from the back panel. The suspension panel may include a bottom edge portion. The at least part of at least one of the upper edge portion and exterior side edge portion of the at least one resilient member may be attached to at least one of the back panel and the suspension panel.

Additionally or separately, an entire length of the exterior side edge portion of the at least one resilient member may be attached to at least one of the back panel assembly and the frame member. An entire length of the top edge portion of the at least one resilient member may be attached to at least a portion of the bottom edge portion of the suspension panel.

At least a portion of the interior side edge portion of the at least one resilient member may be extended along and coupled to at least a portion of a height of an adjacent lateral edge portion of the central portion of the load support assembly. The interior side edge portion, in one example, may extend along and be coupled to the entirety of the height of the central portion of the load support assembly.

Additionally or separately, a bottom edge portion of the load support assembly may couple to the frame assembly forming a load bearing seam.

Additionally or separately, a bottom portion of the at least one resilient member may be coupled to an anchor. The anchor may limit rotation and flex at the bottom portion of the resilient panel.

Additionally or separately, when force is applied to the load support assembly, the at least one resilient member may stretch in a direction of the applied force. When the applied force is removed, the at least one resilient member may substantially return to an original position.

Additionally or separately, the at least one resilient member may form an elongated panel adjacent to the load support assembly. Additionally or separately, the at least one resilient member may include two laterally spaced resilient panels positioned on opposite sides of the central portion of the load support assembly. Additionally or separately, the at least one resilient member may include at least two elastic fabric panels. Additionally or separately, the at least one resilient member may include at least one strap.

Other examples or embodiments of the present disclosure may include a backpack having a frame assembly, a load support member including a central portion, and at least one resilient member coupling the frame assembly to the load support member. The at least one resilient member may have a length and a width and may form a flat and elongated shape. The at least one resilient member may stretch along the length and the width. Additionally or separately, the at least one resilient member may also include two laterally spaced resilient members positioned on opposite sides of the central portion of the load support member. The at least one resilient member may also transition between a first state and a second state as the load support member and frame assembly move relative to one another to reduce the forces applied to the load support member by the non-vertical movement of the frame assembly.

Additional examples or embodiments of the present disclosure may include a backpack having a load supporting belt having a top edge and at least one side edge, and a suspension panel having a bottom portion. Additionally or separately, the backpack may also include at least one resilient member with a first edge and a second edge. Each edge may define a length. The at least one resilient member may couple to at least one of the top edge and the at least one side edge of the load supporting belt along at least a portion of the length of the first edge. The at least one resilient member may also couple to the bottom portion of the suspension panel along at least a portion of the length of the second edge.

Additionally or separately, the load supporting belt may have a bottom edge, and the backpack may include a frame assembly, wherein the bottom edge of the load supporting belt is coupled to a bottom portion of the frame assembly forming a load bearing engagement.

Additional examples or embodiments of the present disclosure may include a resilient hip belt for a backpack. The hip belt may include two arms extending from a central portion. The central portion may have opposing lateral portions. Two laterally spaced resilient members may be positioned on opposite sides of the central portion of the hip belt. When a force is applied to the hip belt, the resilient members stretch in a direction of the applied force. When the applied force is removed, the resilient members substantially return to an original position.

Additional examples or embodiments of the present disclosure may include a backpack. The backpack may include a frame assembly. The backpack may include a hip belt. The hip belt may include a central portion. The central portion may have opposing first and second arms extending from the central portion and opposing lateral portions. At least one resilient panel may couple the hip belt to the frame assembly. The at least one resilient panel may define opposing upper and lower edge portions, and opposing interior and exterior side edge portions. The at least one resilient panel may expand or contract as the hip belt and frame assembly move relative to one another to reduce forces applied to the hip belt by non-vertical movement of the frame assembly.

Additionally or separately, the at least one resilient panel may form an elongated panel coupling the hip belt to the frame assembly. Additionally or separately, the at least one resilient panel may include two laterally spaced resilient panels each coupled between the frame assembly and the central portion of the hip belt.

Additionally or separately, the relative movement of the hip belt and the frame assembly may be at least one of a rotational motion and a twisting motion. Additionally or separately, the relative movement of the hip belt and the frame assembly may be at least a pivoting motion (e.g. such as movement about a point or points in a curved path).

Additionally or separately, at least a part of the interior side edge portion of the at least one resilient panel may be attached to the hip belt and at least part of at least one of the upper edge portion and exterior side edge portion may be attached to the frame assembly.

Additionally or separately, the frame assembly may include a back panel assembly. The back panel assembly may define opposing first and second side edge portions. The frame assembly may include a frame member disposed about a perimeter of the back panel assembly. The at least part of at least one of the upper edge portion and exterior side edge portion of the at least one resilient panel may be attached to at least one of the back panel assembly and the frame member.

Additionally or separately, the back panel assembly may include a back panel. The back panel may define opposing first and second side edge portions. The at least part of at least one of the upper edge portion and exterior side edge portion of the at least one resilient panel may be attached to the back panel.

Additionally or separately, the back panel assembly may include a suspension panel coupled to at least an upper portion of the back panel and spaced apart from the back panel. The suspension panel may include a bottom edge portion. The at least part of at least one of the upper edge portion and exterior side edge portion of the at least one resilient panel may be attached to at least one of the back panel and the suspension panel.

Additionally or separately, an entire length of the exterior side edge portion of the at least one resilient panel may be attached to at least one of the back panel assembly and the frame member.

Additionally or separately, an entire length of the upper edge portion of the at least one resilient panel may be attached to at least a portion of the bottom edge portion of the suspension panel.

Additionally or separately, at least a portion of the interior side edge portion of the at least one resilient panel may extend along and be coupled to at least a portion of a height of an adjacent lateral portion of the central portion of the hip belt. Additionally or separately, the interior side edge portion may extend along and be coupled to the entirety of a height of the adjacent lateral portion of the central portion of the hip belt.

Additionally or separately, a bottom edge portion of the hip belt may couple to the frame assembly forming a load bearing seam to support a substantially vertical load applied between the frame assembly and the hip belt.

Additionally or separately, when force is applied to the hip belt, the at least one resilient panel may stretch in a direction of the applied force, and when the applied force is removed, the at least one resilient panel may substantially return to an original position.

Additional examples or embodiments of the present disclosure may include a backpack. The backpack may include a frame assembly. The backpack may include a hip belt including a central portion. The backpack may include at least one resilient member coupling the frame assembly to the hip belt. The at least one resilient member may have a length and a width and may define a flat and elongated shape. The at least one resilient member may be stretchable along the length and the width.

Additionally or separately, the at least one resilient member may include two laterally spaced resilient members positioned on opposite sides of the central portion of the hip belt. Additionally or separately, the at least one resilient member may include at least one strap.

Additionally or separately, the at least one resilient member may transition between a first state and a second state as the hip belt and the frame assembly move relative to one another to reduce the forces applied to the hip belt by non-vertical movement of the frame assembly.

Additional examples or embodiments of the present disclosure may include a backpack. The backpack may include a hip belt having a top edge portion and at least one side edge portion. The backpack may include a suspension panel having a bottom portion. The backpack may include at least one resilient member with a first edge portion and a second edge portion. Each edge portion may define a length. The at least one resilient member may couple to at least one of the top edge portion and the at least one side edge portion of the hip belt along at least a portion of the length of the first edge portion. The at least one resilient member may couple to the bottom portion of the suspension panel along at least a portion of the length of the second edge portion.

Additionally or separately, the hip belt may have a bottom edge portion. The backpack may further include a frame assembly. The bottom edge portion of the hip belt may be coupled to a bottom portion of the frame assembly forming a load bearing engagement to support a substantially vertical load applied between the frame assembly and the hip belt.

Additional embodiments and features are set forth in part in the description that follows, and will become apparent to those skilled in the art upon examination of the specification or may be learned by the practice of the disclosed subject matter. A further understanding of the nature and advantages of the present disclosure may be realized by reference to the remaining portions of the specification and the drawings, which forms a part of this disclosure. One of skill in the art will understand that each of the various aspects and features of the disclosure may advantageously be used separately in some instances, or in combination with other aspects and features of the disclosure in other instances.

BRIEF DESCRIPTION OF THE DRAWINGS

The description will be more fully understood with reference to the following figures in which components are not drawn to scale, which are presented as various examples of the present disclosure and should not be construed as a complete recitation of the scope of the disclosure, characterized in that.

DETAILED DESCRIPTION

This disclosure is related to a backpack with a flexible hip belt assembly. Depending on the embodiment, the backpack may include a cargo bag or sack, a frame assembly, a resilient panel, and a hip belt. The frame assembly may include a frame member, a back panel assembly, and a support panel. The back panel assembly may include several panels or layers, including a back panel and a suspension panel. In one embodiment, the hip belt is resiliently coupled to the frame assembly by the resilient panel. The resilient panel expands and contracts as the hip belt and frame assembly move relative to one another to reduce the forces applied to the hip belt by the non-vertical movement of the frame assembly.

In operation, the resilient panel at least in part couples the hip belt to the frame assembly to generally isolate the movement of the hip belt from the movement of the frame assembly. Since the hip belt engages a wearer's hip region, the hip belt moves with the wearer's hips. The frame assembly supports the cargo bag, which may include a cargo load of up to 50 or more pounds. The frame assembly then includes a load that creates a moment force generally about the attachment between the hip belt and the frame assembly. This cargo load moves, such as swaying, and has an associated momentum that can be transmitted through a traditional connection structure between a frame assembly and a hip belt, and then to the wearer, which can create undesirable effects. The connection structure between the hip belt and the frame assembly disclosed here, and, in particular, the resilient panels as used in this structure, allows the hip belt and frame assembly to move relative to each other to at least partially de-link the movement of the cargo load from the motion of the hip belt. This result is referred to herein as "hip belt flexibility." This de-linking reduces the undesirable forces applied by the moving cargo load to a wearer through the hip belt. This provides advantages over traditional systems, such as, in one example, reduced energy consumption and increased comfort for a wearer. In addition, the resilient panel provides a simplified approach to improving hip belt flexibility that has functional and commercial advantages over the more complex existing systems.

Figure 1:
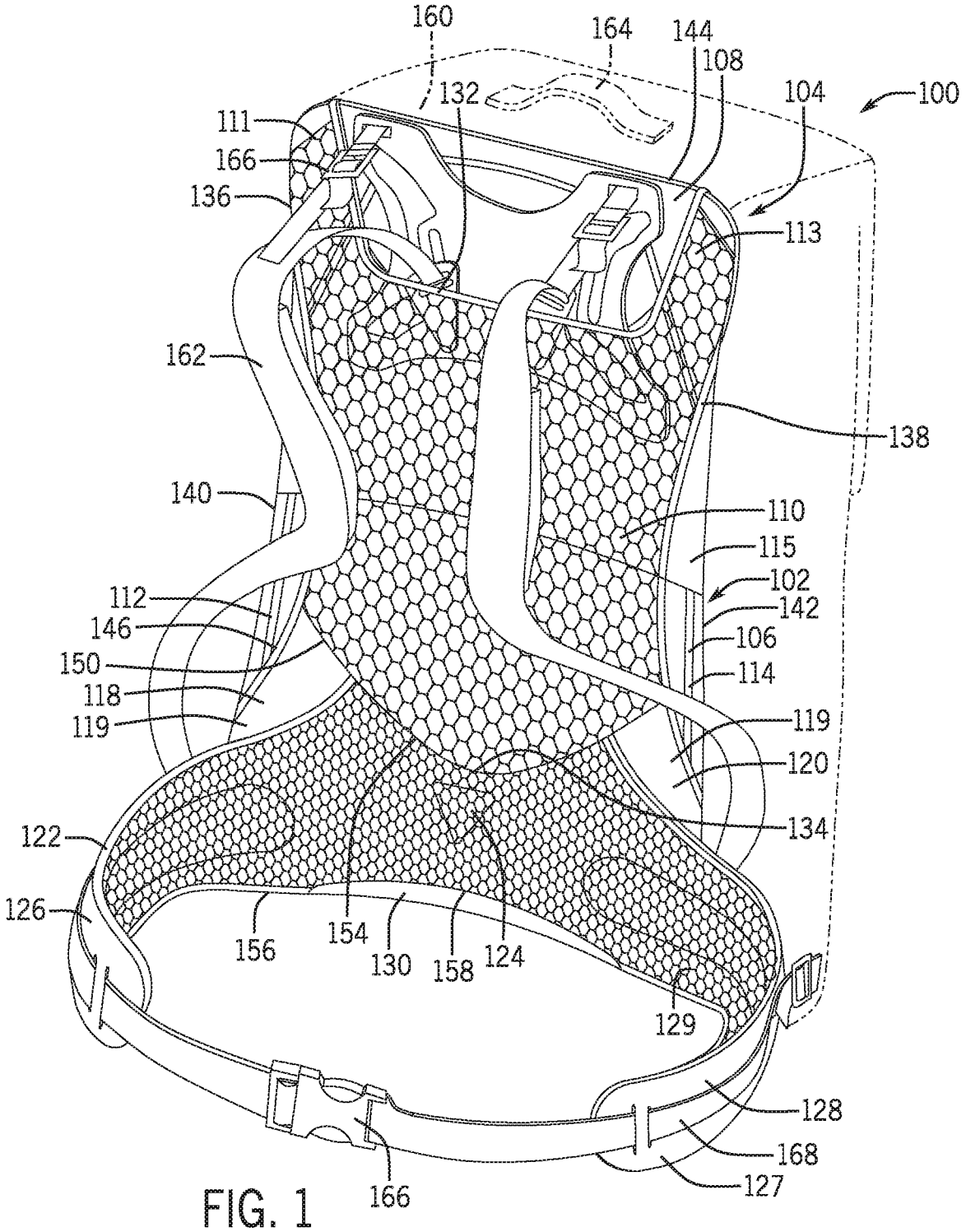
FIG. 1 is a front right perspective view of a backpack in accordance with one example, depicting a hip belt with a resilient attachment.
Figure 2A:
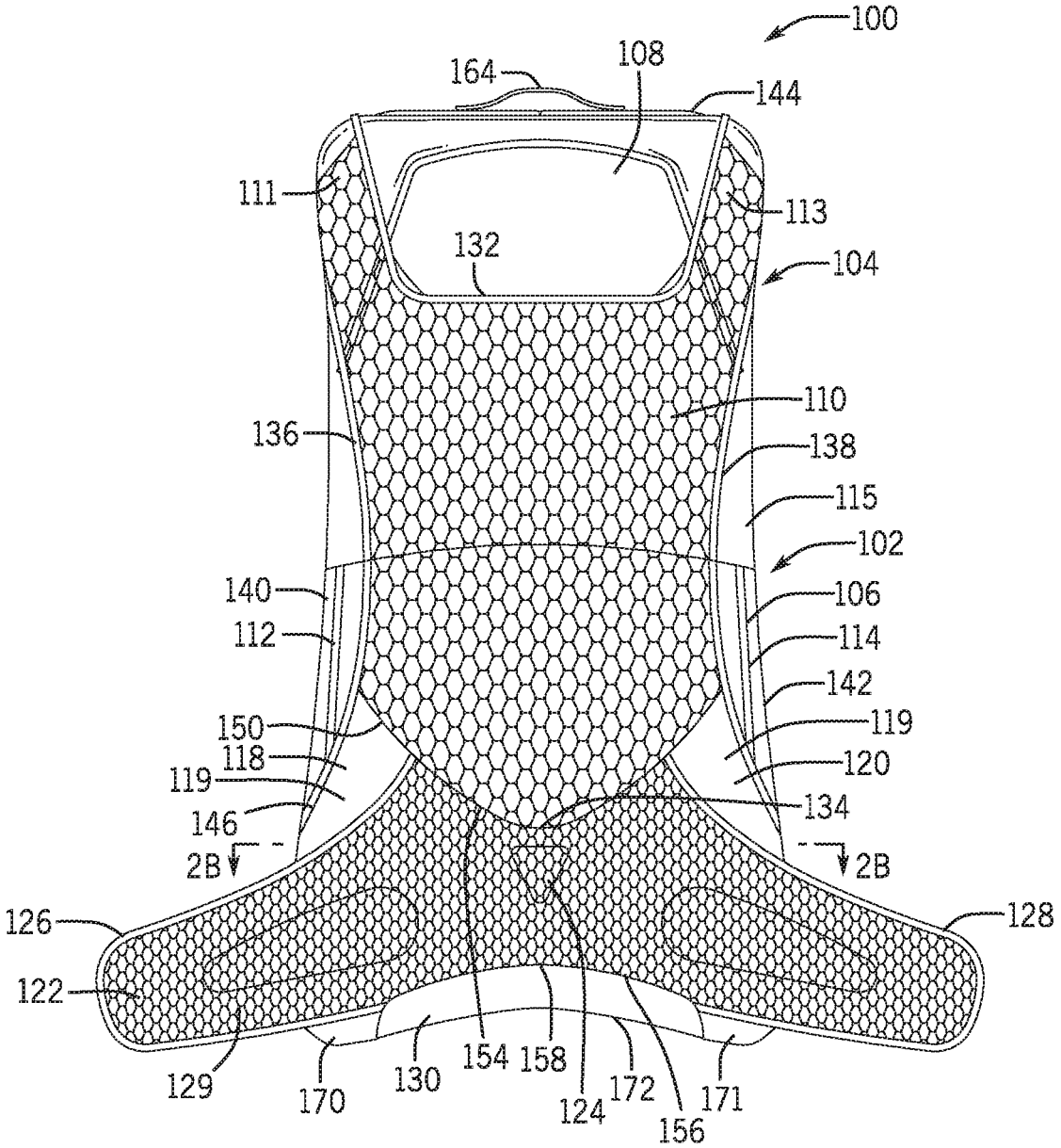
FIG. 2A is a front elevation view of the backpack of FIG. 1 with the shoulder straps removed.
Figure 2B:
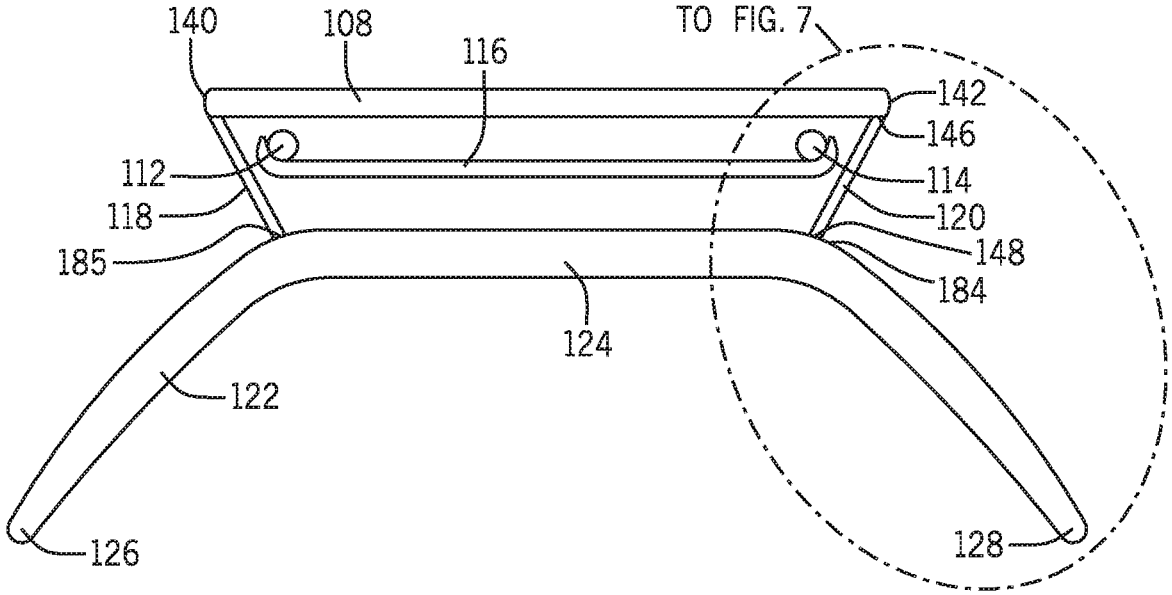
FIG. 2B is a top plan view of the backpack of FIG. 2A in a schematic cross-section, showing the arrangement of the backpack features behind the hip belt.
Figure 3:
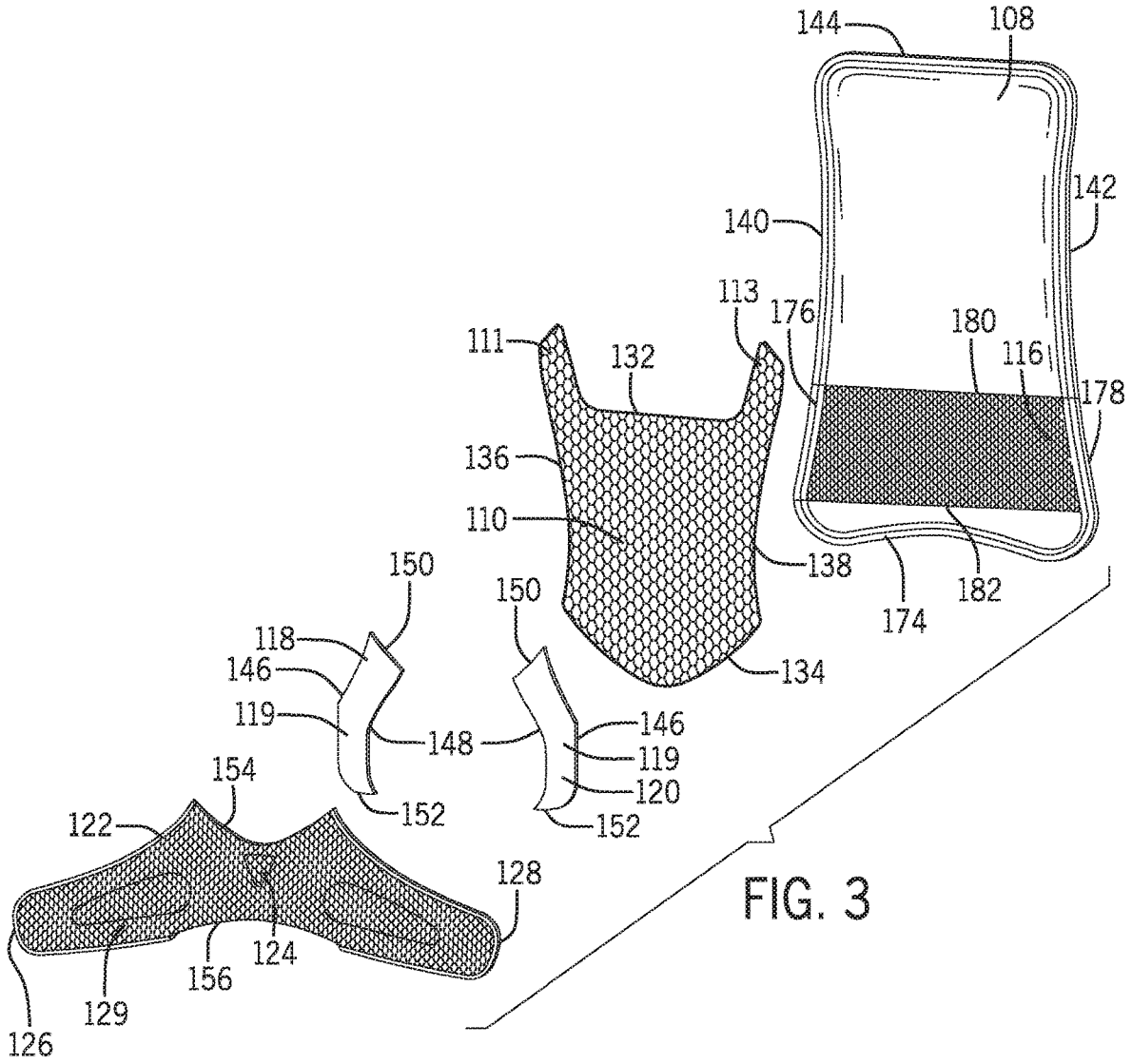
FIG. 3 is a perspective partially exploded view of the backpack of FIG. 2A, showing the back panel, suspension panel, resilient panels, and hip belt.

Turning now to the figures, a backpack 100 with a flexible hip belt assembly of the present disclosure is shown in FIG. 1. FIG. 1 is a perspective view of a backpack 100 in accordance with one embodiment, depicting a hip belt 122 with a resilient attachment to a frame assembly 102. FIG. 2A is a front elevation view of the backpack 100 of FIG. 1 with the shoulder straps 162 removed. FIG. 3 is a perspective partially exploded view of the backpack 100 of FIG. 2A, showing the back panel 108, suspension panel 110, resilient panels 118, 120, and hip belt 122. As shown in FIGS. 1-3, the backpack 100 may include a frame assembly 102, a hip belt 122, one or more resilient panels 118, 120, a bottom panel 130, one or more cover panels 170, 171, and other common backpack features, such as a sack 160, shoulder straps 162, one or more handles 164, buckles 166, adjustment straps 168, and the like.

The sack 160 is supported on the frame assembly 102, which may include a back panel assembly 104, a frame member 106, and a support panel 116. The back panel assembly 104 is positioned on the back side of the backpack 100, i.e. the side that faces a wearer's back. The back panel assembly 104 may be made up of one or more panels or layers. For example, the back panel assembly 104 may include one or more of a back panel 108, a foam layer 115, and a suspension panel 110. The back panel 108 is the panel closest to the front side of the backpack 100 in the back panel assembly 104. The back panel 108 may be of any shape that is compatible to engage with a wearer's back and support a sack for carrying cargo. For example, the back panel 108 may be an oval shape, a rectangular shape, or the like, and may be curved or flat. In this example, and as shown in FIG. 2A, the back panel 108 is a generally flat rectangular shape with a top edge portion 144, a bottom edge portion 174, and opposing first and second side edge portions 140, 142. The back panel 108 may be made of a variety of materials, such as man-made (e.g. nylon), natural materials (e.g. cotton, leather) or a combination.

As shown in FIGS. 1-3, the back panel assembly 104 may also include a suspension or float panel 110. The suspension panel 110 defines a central body defining a peripheral edge. At least a portion or a plurality of portions of the peripheral edge are secured to the edge portions 140, 142, 144, 174 of the back panel 108, and the central body is spaced away from the back panel 108. The suspension panel 110 is configured to contact a wearer's back. The suspension panel 110 may be any shape configured to run along at least a portion of the length of the wearer's back, and the shape of the suspension panel 110 may vary with the shape of the backpack 100 and the back panel 108 in particular. The suspension panel 110 is smaller than the back panel 108, and, in this example, does not extend beyond the top, bottom and opposing side edge portions 144, 174, 140, 142 of the back panel 108. The suspension panel 110 shown in the figures has a first side edge portion 136, a second side edge portion 138, a top edge portion 132 in a concave curved shape and a bottom edge portion 134 having a convex curved shape. The top edge portion 132 and the first side edge portion 136 intersect to form a first upper extended portion 111, and the top edge portion 132 and the second side edge portion 138 intersect to form a second upper extended portion 113. The suspension panel 110 may be a non-extensible material, such as open mesh, foam padding, molded foam panel, spacer mesh, nylon woven fabric, polyester woven fabric, or the like. For example, the suspension panel 110 may be made up of one or more layers of netting, or may be a solid sheet. The shape of the edges of the suspension panel 110 may be other than the curves as described above.

The frame member 106 may be included in the frame assembly 102 to provide structural strength and rigidity to the back panel assembly 104. The frame member 106 may have a generally rectangular shape, and be positioned, as in this example, generally around the periphery of the back panel 108. The frame member 106, in this instance, provides the structural support for tensioning the suspension panel 110 so that it is taught, and spaced away from the back panel 108. The frame member may include one or more of a top support (not shown), a bottom support (not shown), a first side support 112 and a second side support 114. The frame member 106 may be any one of numerous frame structures, such as, for example, an external or internal frame. The frame member 106 may be made of plastic, metal wire, metal rods, or any other similar materials. It is also contemplated that the backpack 100 may be frameless. As shown in FIGS. 1 and 2A, the frame member 106 is made of a bent-metal rod.

The support panel 116, shown in FIG. 3, is coupled to and extends laterally between lower portions of the opposing first and second side supports 112, 114 of the frame member 106. The support panel 116 is under tension and biases the lower portions of the side support members 112, 114 towards each other. The support panel 116 may be a generally rectangular or trapezoidal shape with a top edge portion 180, a bottom edge portion 182, and opposing first and second side edge portions 176, 178. The support panel 116 may be any strong, generally inextensible material, such as, for example, a monofilament mesh, nylon, polyester, webbing, foam, non-woven fabric, or the like. The support panel 116, as noted below, is positioned behind the hip belt assembly, and helps support the hip belt assembly away from the back panel 108.

As shown in FIG. 1, the hip belt 122, load supporting belt, or load support assembly or member, is coupled to a lower portion of the frame assembly 102, and may extend outwardly from the backpack 100 in a U- or C-shape, such that it can be secured around and conform to a wearer's hip region. The hip belt 122 includes a central portion 124, with opposing right and left wings or arms 126, 128 that extend outwardly from opposing right and left lateral portions 185, 184 of the central portion 124. The right and left lateral portions 185, 184, of the central portion may be referred to herein as an "edge", however the edge portions 185, 184 may or may not be denoted by such a structural feature. For instance, the opposing lateral portions 184, 185 of the central portion 124 may be defined by a location where the arms 126, 128 begin to extend away from the frame assembly 102 to wrap around a user's waist. The central portion 124 is generally positioned in a central region relative to the lateral width of the frame assembly 102. The height dimension of the central portion 124 may be greater than the height dimension of the arms 126, 128. The right and left arms 126, 128 are configured to extend around the sides of a wearer and couple in the front of the wearer by a buckle 166. The arms 126, 128 may be adjustable to accommodate different body circumferences. The hip belt 122 defines an upper edge portion 154 and a lower edge portion 156, both of which in this example extend along both the central portion 124 and the arms 126, 128. The hip belt 122 also has a front surface 129, which is the surface that contacts the wearer, and a rear surface 127 facing the support panel 116 and back panel 108.

The hip belt 122 is attached to the frame assembly 102 at a variety of locations to provide both vertical support for the cargo load, as well as the relatively independent rotational movement discussed above. The vertical support for the cargo load is provided by a fixed connection between the lower edge portion 156 of the hip belt 122 and the bottom portion of the frame assembly 102. A resilient attachment is provided by connecting a right and left resilient panel 118, 120 along portions of the right and left lateral portions 185, 184 of the central portion 124 and to the frame assembly 102, which is described in more detail below. As referred to herein, "vertical direction" means generally along a direction of the long length of the frame assembly (for example along a side edge portion 140, 142), "horizontally" or "lateral direction" means generally orthogonal to the direction of the long length of the frame assembly, and "non-vertical" means generally along a direction that includes a lateral component.

The hip belt 122 may be made of several layers. For example, the hip belt 122 may include at least one of a nylon layer for support, a foam layer for comfort, and a mesh layer for ventilation. In other embodiments, various other materials having sufficient structural strength and flexibility can be used, e.g., composites, e.g., glass-fiber composites; and plastics, e.g., thermoplastics and/or thermosets singly or in combination. It is also contemplated that the hip belt 122 is any existing belt used to support a load for one's back. For example, the hip belt 122 may be two straps that fasten together or it may be a padded structure with pockets.

The resilient attachment may include a plurality of resilient panels 118, 120, straps, or members at least partially coupling the hip belt 122 to the frame assembly 102. As shown in the embodiment in FIGS. 1-3, the resilient attachment is a plurality of resilient panels 118, 120, which in this example includes an elongated arcuately-shaped panel secured between each lateral portion 185, 184 of the central portion 124 of the hip belt 122 and the back panel assembly 104. Alternatively, each resilient panel 118, 120 may be attached adjacent to the opposing lateral portions 185, 184 and couple to the back panel 108 or frame assembly 102. In an alternate embodiment, the resilient attachment may be at least one resilient strap that has a more discrete connection location than the resilient panels depicted. The resilient strap may include a strap with two ends, or a strap with two or more ends such as, for example, a Y shape, with one end connected to the hip belt and one of the remaining ends attached to at least one of the back panel assembly and the frame member.

As shown in FIG. 3, the resilient panels 118, 120 each have an exterior side edge portion 146, an interior side edge portion 148, a top edge portion 150, a bottom edge portion 152, a front surface 119, and a back surface (not shown). The exterior side edge portion 146 is the edge portion closest to the side edge portion 140 or 142 of the back panel 108 and the interior side edge portion 148 is the edge portion closest to the hip belt 122. The edge portions 146, 148, 150, 152 of the resilient panels 118, 120 each define a length. The front surface 119 is the surface that faces outward toward a wearer, while the back surface is the surface that faces inward toward the back panel 108 and sack 160. In the depicted embodiment, the top edge portion 150 is at an angle; however, it is contemplated that the top edge portion 150 may be a straight edge, or have another shape, depending upon the corresponding shape of the suspension panel 110. As used herein, an "edge" or "edge portion" may or may not be denoted by such a structural feature. For instance, an edge or edge portion may be a portion adjacent to and near the actual free-end of a structural component, such as, for example, the resilient panels 118, 120. An edge may also denote a portion of a structural component that attaches to another structural component of the backpack 100. For example, an edge or edge portion of the resilient panels 118, 120 may refer to a portion of the resilient panels 118, 120 that attaches (such as by sewing, in one example) to the hip belt and/or frame assembly, even though the free edge portion of the resilient panel may extend beyond where attachment is located (e.g. where the sewing line is, in one example).

The resilient panels 118, 120 may be made of many types of stretchable, flexible, and/or elastic material that allows for rotation and flex, and is durable to withstand the forces applied between the frame assembly and the hip belt. For example, the resilient panels 118, 120 may be made of a fabric, mesh or webbing, an open mesh, or similar material having elastic properties. As one example, the resilient panels may be made of DS16-S54 Spiral Embo by Duck San Co., Ltd. The resilient panels 118, 120 may be stretch woven or knit or a fabric with mechanical stretch. The resilient panels 118, 120 have a rebound or memory characteristic that is configured to return entirely or substantially to an initial or pre-stretched position original position after being displaced by a force. The resilient panels may have a flat shape when in initial or pre-stretched position, or when under tension; or they may have other single or compound shapes, such as having a twist, buckle, crease, or the like. In one example, the resilient panel may include a lamina of more than one layer. For instance, the panel may include a top and bottom layer with an intermediate layer formed of monofilament elements. There may be more or fewer layers. Each layer of the lamina may be made of the same or different material, such as polyester, nylon, or similar.

Figure 8:
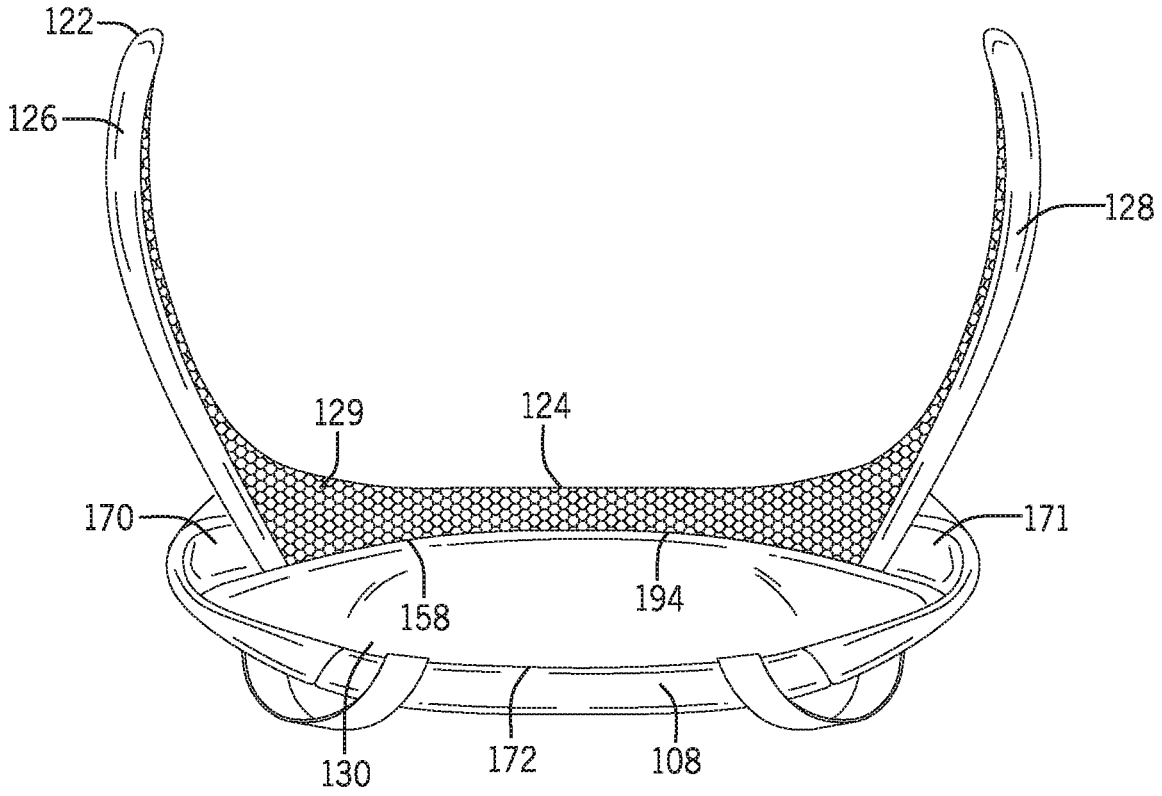
FIG. 8 is a bottom plan view of the backpack of FIG. 1, showing the bottom panel and the hip belt.

The bottom panel 130, or load bearing panel, as shown in FIGS. 2A and 8, may be positioned on the bottom portion of the backpack 100, connected between the hip belt 122 and the frame assembly 102. The bottom panel 130 acts as a load bearing component to transfer the vertical load from sack 160 to the hip belt 122. The bottom panel 130 has opposing front and back edge portions 172, 194, and extends laterally across the mid-line of the backpack 100, and generally underneath the central portion 124 of the hip belt 122. The front edge portion 172 may be fixedly connected to the frame assembly 102, and the back edge portion 194 may be fixedly connected to a bottom portion of the central portion 124 of the hip belt 122. The bottom panel 130 may be any strong material to support a load, such as, for example, nylon, polyester, webbing, static mesh, non-woven fabric, or the like.

Figure 7:
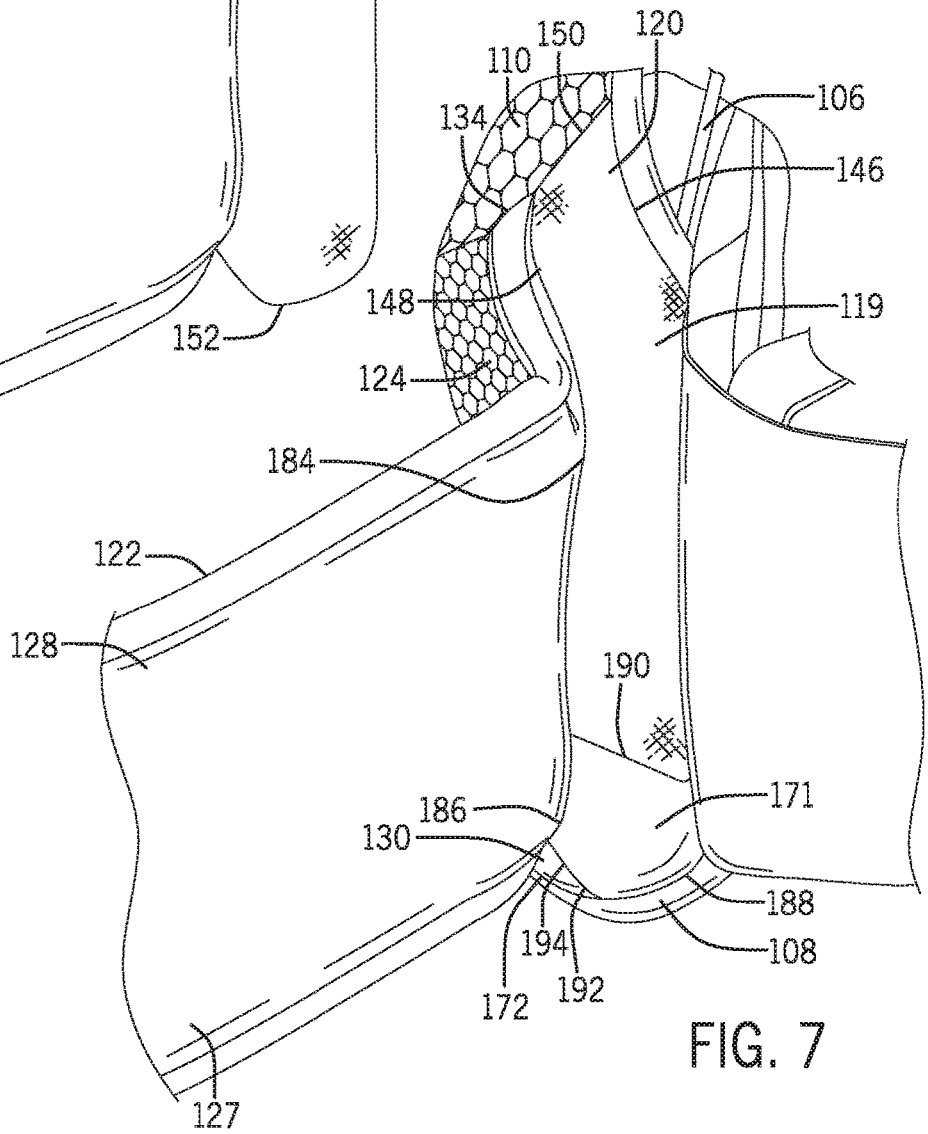
FIG. 7 is an isolated isometric view of the left side of the hip belt attached to the frame assembly by the resilient panel for the backpack of FIG. 1.

As shown in FIGS. 2A, 7, and 8, the backpack 100 may include one or more cover panels, such as a right cover panel 170 and a left cover panel 171, each positioned on an outer edge portion of the lower portion of the backpack. Each cover panel 170, 171 overlaps with and couples to lower portions of the resilient panels 118, 120 between the hip belt 122 and frame assembly 102. In the embodiment depicted in FIGS. 2A and 8, the backpack 100 has two cover panels 170, 171, each positioned at least partially on the frame assembly 102 and on either side of the hip belt 122. The cover panels 170, 171 may provide added rigidity to the lower portions of the resilient panels 118, 120 or additionally or separately protect the resilient panels 118, 120 from abrasion. As shown, each cover panel 170, 171 has an inner side edge portion 186, an outer side edge portion 188, a top edge portion 190, and a bottom edge portion 192. The cover panels 170, 171 may be made of any strong material to resist abrasion, such as, for example, nylon, or the like. The cover panels 170, 171 may be made of substantially the same material as the bottom panel 130.

With reference to FIGS. 1-3 and 5-8, the coupling and/or assembly structure of the components described above will be discussed in more detail. FIG. 2B provides a schematic cross-sectional view of the various layers and components of the backpack 100 of FIG. 2A, taken along line 2B-2B. As shown in the figure, the hip belt 122 is spaced away, in this configuration, from the support panel 116, the frame member 106, and the back panel 108. The hip belt 122 is attached to the opposing side edge portions 140, 142 of the frame assembly 102 by the resilient panels 118, 120. In the embodiment shown in FIG. 2B, the resilient panels 118, 120 attach the hip belt 122 to the back panel 108, and more specifically attach an upper part of the central portion 124 of the hip belt 122 to the back panel 108. The support panel 116 is attached to the frame member 106, specifically to the first and second side supports 112, 114, in a tensioned engagement and is positioned behind the hip belt 122 to provide additional support for a wearer's lower back and hips.

With reference to FIGS. 1 and 2A, the back panel 108, frame member 106, support panel 116, and suspension panel 110 may be operably attached to form the frame assembly 102. As shown, the frame member 106 may include a bent-metal rod. The bent-metal rod may be positioned around the perimeter of the back panel 108 and held in place through tension forces. In an alternate embodiment, the bent-metal rod may be enclosed by material that attaches to the back panel 108. The material may partially or entirely enclose the bent-metal rod. The frame member 106 may be made of other materials such as wire, pulltrusions connected together with corner pieces, or other like structures.

As shown in FIG. 3, the support panel 116 may attach, in a tensioned engagement, to a lower portion of the frame member 106 near the first and second side edge portions 140, 142 of the back panel 108; however, it is also contemplated that the support panel 116 attaches to the first and second side edge portions 140, 142 of the back panel 108 as well or in isolation. The first side edge portion 176 of the support panel 116 couples to the first side support 112, and the second side edge portion 178 of the support panel 116 couples to the second side support 114 in a manner that places the support panel 116 in a taut engagement with the frame member 106.

The suspension panel 110 may be attached to at least an upper portion of the backpack 100. As shown, the first upper extended portion 111 of the suspension panel 110 is coupled to the first side edge portion 140 and the top edge portion 144 of the back panel 108 and may also be attached to the frame member 106. The second upper extended portion 113 of the suspension panel 110 is coupled to the second side edge portion 142 and the top edge portion 144 of the back panel 108 and may also be attached to the frame member 106. Alternatively, the suspension panel 110 may only attach to the frame member 106. In another embodiment, the suspension panel 110 or the upper extended portions 111, 113 may only attach to one edge portion of the back panel 108. The attachment of the suspension panel 110 to the backpack 100 places the suspension panel 110 in a suspended position, such that it is spaced away from back panel 108. In this position, the suspension panel 110 is taught and inextensible, such that when the suspension panel 110 is attached to the upper edge portion 154 of the hip belt 122, as discussed in more detail below, the tension runs from the top of the frame assembly 102, through the suspension panel 110, the hip belt 122, and the bottom panel 130, terminating at the engagement between the bottom panel 130 and the frame assembly 102.

As shown in FIGS. 1, 2A, 6, and 7, the hip belt 122 is attached to the frame assembly 102 by the resilient panels 118, 120. FIG. 7 shows an isolated view of the left side of the hip belt 122 attached to the frame assembly 102 by the resilient panel 120, as shown in FIG. 2B. The resilient panels 118, 120 may be coupled to the frame assembly 102 at one or more locations. In one example, the resilient panels 118, 120 may be coupled to the frame assembly 102 at two or four locations of attachment. In the depicted embodiment, two resilient panels 118, 120 are each coupled to at least a lower portion of the suspension panel 110. At least a portion, a discrete point, or a continuous edge portion of the top edge portion 150 of each resilient panel 118, 120 attaches to at least a portion of the bottom edge portion 134 of the suspension panel 110. As shown, the top edge portion 150 of each resilient panel 118, 120 may be shaped to match the curvature of the suspension panel 110 to which it is attached. This allows for the entire top edge portion 150 of each resilient panel 118, 120 to attach to the bottom edge portion 134 of the suspension panel 110. Each of the resilient panels 118, 120 attaches to the lower portion of the suspension panel 110 on opposite sides of the central portion 124 of the hip belt 122, such that the right resilient panel 118 is adjacent to the first side edge portion 140 of the back panel 108 and the left resilient panel 120 is adjacent to the second side edge portion 142 of the back panel 108.

The resilient panels 118, 120 may be attached to a lower portion of the frame assembly 102. As shown in FIG. 7, the exterior side edge portion 146 of each resilient panel 118, 120 may attach to the adjacent first side or second side edge portions 140, 142 of the back panel 108. The resilient panels 118, 120 may also attach to the frame member 106. Alternatively, the resilient panels 118, 120 may only attach to the frame member 106. As shown in the depicted embodiment, and more detailed in FIG. 7, the attachment of the resilient panels 118, 120 to the frame assembly 102 extends along a lower portion of the frame assembly 102 to the bottom panel 130. In other examples, the resilient panels 118, 120 may not extend all the way to the bottom panel 130. It is contemplated that the attachment of the exterior side edge portions 146 of the resilient panels 118, 120 to the frame assembly 102 may be along the entirety of the exterior side edge portions 146, along at least a portion of the exterior side edge portions 146, or at one or more discrete points on the exterior side edge portions 146.

Figure 6:
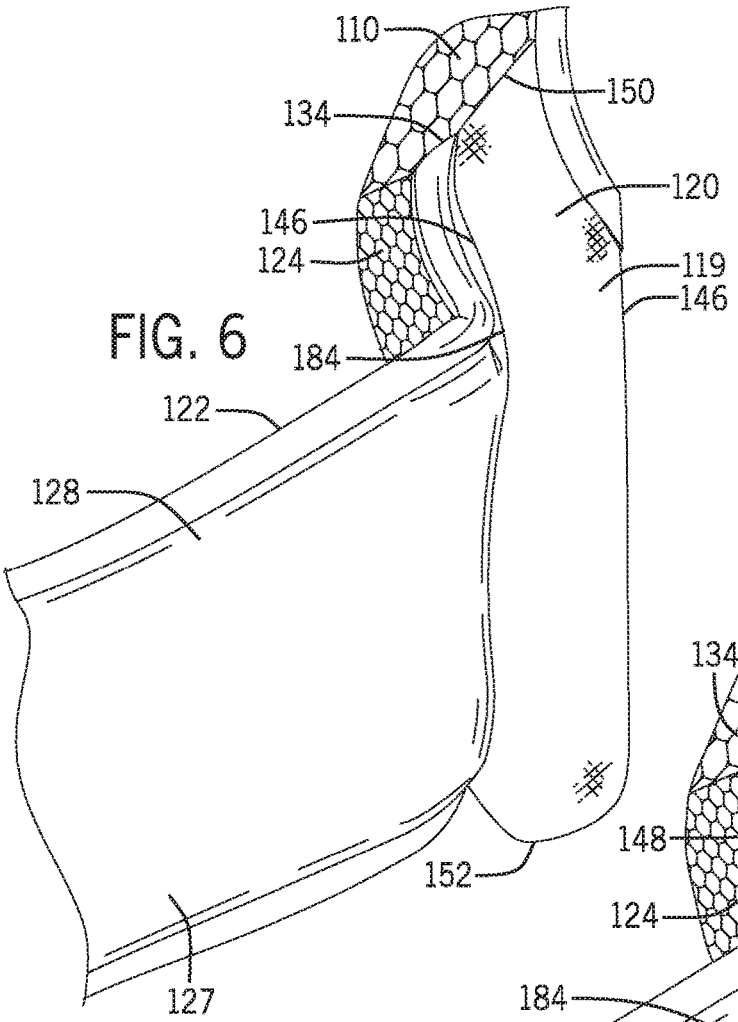
FIG. 6 is an isolated isometric view of the resilient panel engaging the left side of the hip belt for the backpack of FIG. 1.

The resilient panels 118, 120 further attach to the hip belt 122, such that the hip belt 122 is resiliently coupled to the backpack 100. Each of the resilient panels 118, 120 may attach to an adjacent lateral portion 185, 184 of the hip belt 122. FIG. 6 is a schematic isolated view of the left resilient panel 120 attached to the hip belt 122 at the left lateral portion 184 of the central portion 124. As shown in FIG. 6, the resilient panels 118, 120 may be shaped to match the lateral portion 185, 184 of the central portion 124 of the hip belt 122. As shown in FIG. 3, the resilient panels 118, 120 depicted curve in opposite directions, mirroring each other, to conform to the shape of the hip belt 122. As shown, the resilient panels 118, 120 curve inwards towards each other. At least a portion of the interior side edge portion 148 of each resilient panel 118, 120 attaches to the rear surface 127 of the hip belt 122, adjacent the lateral portions 185, 184 of the central portion 124 of the hip belt 122, and along at least a portion of the height of the hip belt 122. It is contemplated that each resilient panel 118, 120 may attach along a continuous edge portion of the hip belt 122, a discontinuous edge portion, or at discrete points. The resilient panels 118, 120 may attach to the hip belt 122 and frame assembly 102 by various conventional means, such as, for example, by stitching or sewing, or other mechanical fastening means. The resilient panels 118, 120 expand and contract as the hip belt 122 and frame assembly 102 move relative to one another.

A cover panel 170, 171 may overlap and attach to a lower portion of each of the resilient panels 118, 120, as shown in FIG. 7. As shown, the left cover panel 171 may cover the front surface 119 of the left resilient panel 120 between the hip belt 122 and the frame assembly 102, and protect it from abrasion. The top edge portion 190 of the left cover panel 171 may attach to the front surface 119 of the left resilient panel 120. The bottom edge portion 192 of the left cover panel 171 may attach to the bottom edge portion 152 of the left resilient panel 120, to a portion of the back edge portion 194 of the bottom panel 130, or to both. In an alternate embodiment, each resilient panel 118, 120 may terminate generally at the top edge portion 190 of each cover panel 170, 171, and at least a portion of the bottom edge portion 152 of each resilient panel 118, 120 may couple to at least a portion of the top edge portion 190 of each cover panel 170, 171. In the embodiment shown in FIG. 7, the inner side edge portion 186 of the left cover panel 171 may attach to a lower portion of the rear surface 127 of the hip belt 122, and the outer side edge portion 188 of the left cover panel 171 may attach to the frame assembly 102, for example, to a lower portion of a side edge portion 140, 142 of the back panel 108, to a lower portion of the frame member 106, or to both. At least one of the bottom panel 130, the cover panels 170, 171, and the frame assembly 102 act as an anchor to prevent rotation and flexion at the bottom portion of each resilient panel 118, 120.

A portion of the hip belt 122 may also attach directly to a portion of the frame assembly 102. As shown in FIGS. 1 and 2A, a top portion of the hip belt 122 may attach to a lower portion of the suspension panel 110. As shown, and in this example, the upper edge portion 154 of the hip belt 122 attaches to a middle portion of the bottom edge portion 134 of the suspension panel 110.

The hip belt 122 is further attached to a lower portion of the frame assembly 102. The hip belt 122 may attach along a lower load bearing seam of the backpack 100 to support the load in the sack 160, primarily in a vertical direction. As shown in FIGS. 1 and 8, the hip belt 122 may attach to the bottom panel 130; however, it is contemplated that the lower portion of the hip belt 122 may attach directly to a lower portion of the frame assembly 102. In the depicted embodiment, the entire lower edge portion 156 of the central portion 124 of the hip belt 122 attaches to a portion of the back edge portion 194 of the bottom panel 130. As mentioned, this creates an anchor between the hip belt 122 and the frame assembly 102 to create a load bearing support for the weight of the articles carried in the backpack 100.

As shown in FIGS. 7 and 8, the bottom panel 130 may be further attached to the resilient panels 118, 120, cover panels 170, 171, and frame assembly 102. In the depicted embodiment, a portion of the back edge portion 194 of the bottom panel 130 attaches to one or both of the bottom edge portions 152 of the resilient panels 118, 120 and to the bottom edge portions 192 of the cover panels 170, 171. The curvature of the bottom edge portions 152 of the resilient panels 118, 120 and of the bottom edge portions 192 of the cover panels 170, 171 generally matches the curvature of the portion of the back edge portion 194 of the bottom panel 130. It is contemplated that the bottom panel 130 and cover panels 170, 171 may be integral components.

The bottom panel 130 may also attach to the frame assembly 102. For example, the bottom panel 130 may attach to a lower portion of the back panel 108. As shown in FIG. 8, the front edge portion 172 of the bottom panel 130 may attach to the bottom edge portion 174 of the back panel 108 forming a seam. The bottom panel 130 may also be coupled to the frame member 106. For example, the frame member 106 may seat near the seam where the bottom panel 130 and back panel 108 intersect. In this configuration, the frame member 106 may be in tensioned engagement with a portion of the bottom panel 130.

The attachment of the hip belt 122 to the frame assembly 102 using the resilient panels 118, 120 as described herein allows the hip belt 122 to move relative to the frame assembly 102. The resilient panels 118, 120 expand and contract as the hip belt 122 and frame assembly 102 move relative to one another to reduce the forces applied to hip belt 122, and thus to the wearer, by the non-vertical movement of the frame assembly 102. The resilient panels may transition between a first, or initial, position or state and a second position or state. In the first position, the resilient panels may be under some or no tension. In the second position, the resilient panels are under tension, such as, for example, being stretched or rotated or twisted along a length, a width, or somewhere in between, such as, for example, in a diagonal direction.

Figure 5:
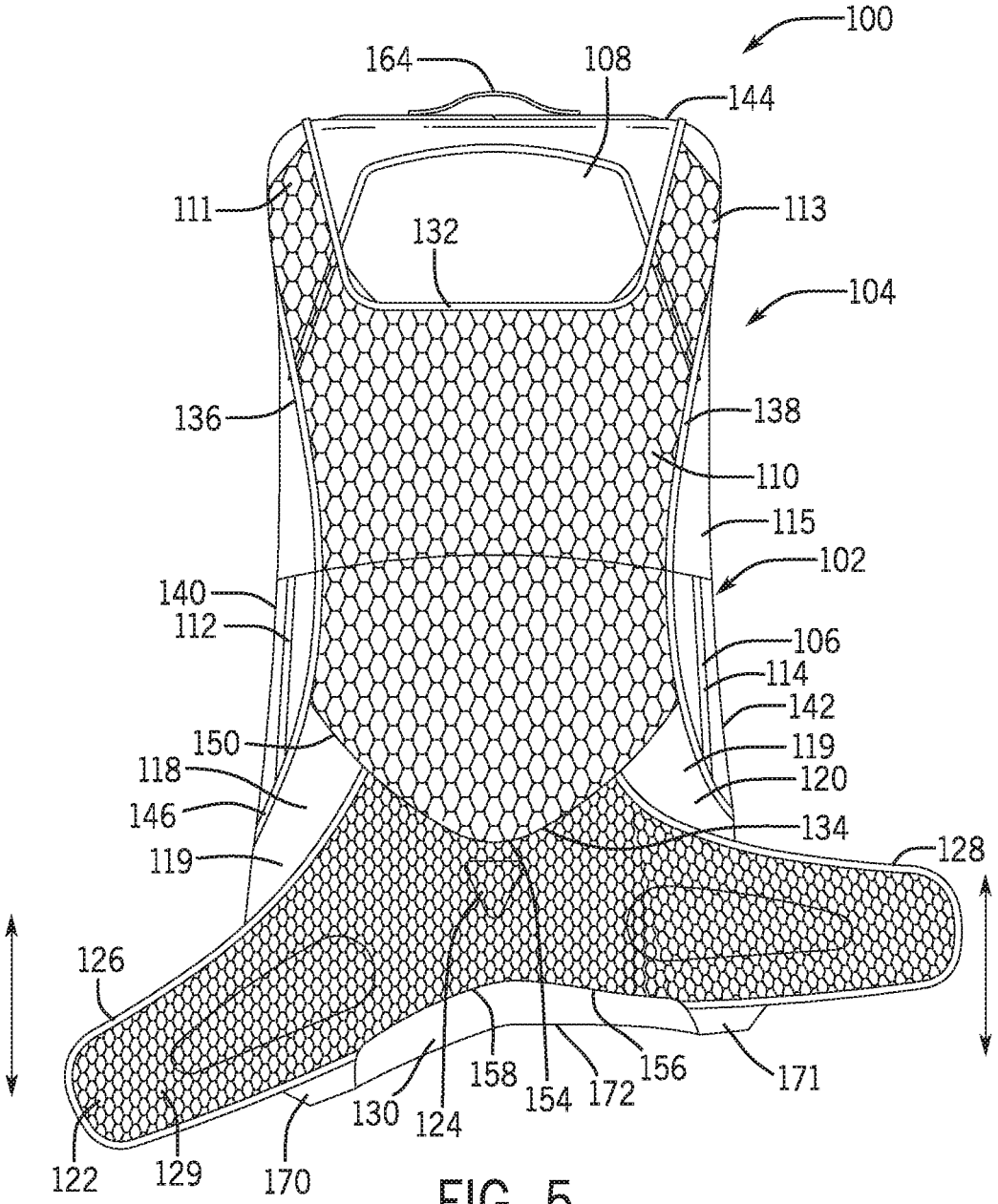
FIG. 5 is a front elevation view of the backpack of FIG. 2A with the hip belt rotated relative to the frame panel assembly.

FIG. 5 is exemplary of this relative movement and is a front elevation view of the backpack 100 of FIG. 2A with the hip belt 122 rotated relative to the frame assembly 102. The hip belt 122 is shown having rotated horizontally in a counter-clockwise direction in a generally vertical plane as defined by the frame assembly of the back pack due to the relative forces on backpack 100, such as forces created by the load carried in the sack 160, and on the hip belt 122, such as forces generated by the wearer, causing the resilient panels 118, 120 to stretch and flex. In this instance, the right resilient panel 118 is pulled and stretched as the right arm 126 of the hip belt 122 moves in a downward direction away from the frame assembly 102. The left resilient panel 120 may be reduced in size or may experience reduced tension as the left arm 128 moves upwardly towards the frame assembly 102. While the relative movement of the hip belt 122 and the frame assembly 102 is shown in the plane of FIG. 5, the motion may also be in different planes, such as into or out of the plane of FIG. 5. The benefits of using the resilient panels 118, 120 in securing the hip belt 122 to the frame assembly 102, as disclosed herein, are also obtained when the relative motion is non-vertical, since a vertical load between the two components is supported by the secured attachment between the central portion 124 of the hip belt 122 and the bottom portion of the frame assembly 102, as described above. The resilient panels 118, 120 store some of the energy transferred to the hip belt 122 due to the relative movement of the frame assembly 102, reducing the amount of energy transferred to the frame assembly 102, and thus keeping the backpack 100 relatively steady as the wearer moves.

The suspension panel 110 may provide additional freedom of motion to the resilient panels 118, 120 and hip belt 122. The attachment between the resilient panels 118, 120 and the suspension panel 110, and between the hip belt 122 and the suspension panel 110, allows the resilient panels 118, 120 and hip belt 122 to be spaced apart from the support panel 116 and the back panel 108. These attachments may allow for greater rotational movement. In addition, the suspension panel 110 provides added comfort and ventilation.

The fixed attachment of the hip belt 122 to the lower portion of the backpack 100 provides vertical load support in order to apply the weight carried in the sack 160 to the wearer's hips. For example, the attachment to the bottom panel 130 along the entire lower edge portion 156 of the central portion 124 of the hip belt 122 reduces or minimizes forces applied to the resilient panels 118, 120. Instead, some of the generally vertical load bearing force is transferred to the hip belt 122 through the attached bottom panel 130, or load-bearing panel. The combination of the resilient attachment of the upper portion of the hip belt 122 to the frame assembly 102 and the more rigid attachment of the lower portion of the hip belt 122 to the bottom panel 130 allows the hip belt 122 to rotate and/or twist with a wearer's body movements relative to the backpack 100 while the vertical load of the pack is largely supported vertically through the hip belt 122. This configuration of the hip belt 122 with the backpack 100 provides vertical stability while allowing for horizontal, and more generally non-vertical, flex capability. The motion of rotating may include at least a motion of translating and or pivoting in a curving manner about at least one point, and, for instance, may include at least partially moving in a vertical plane (for example, the plane of the frame assembly 102 shown in FIG. 1). The motion of twisting may include at least a motion of pivoting and/or translating in a curving motion about at least one axis, and, for instance, may include at least a motion similar to wringing out the water from a wet cloth or towel. The relative movement of the hip belt and the frame assembly may be at least a pivoting motion (e.g. such as movement about a point or points in a curved path), which in one example would be substantially in the plane of the frame assembly.

Figure 4:
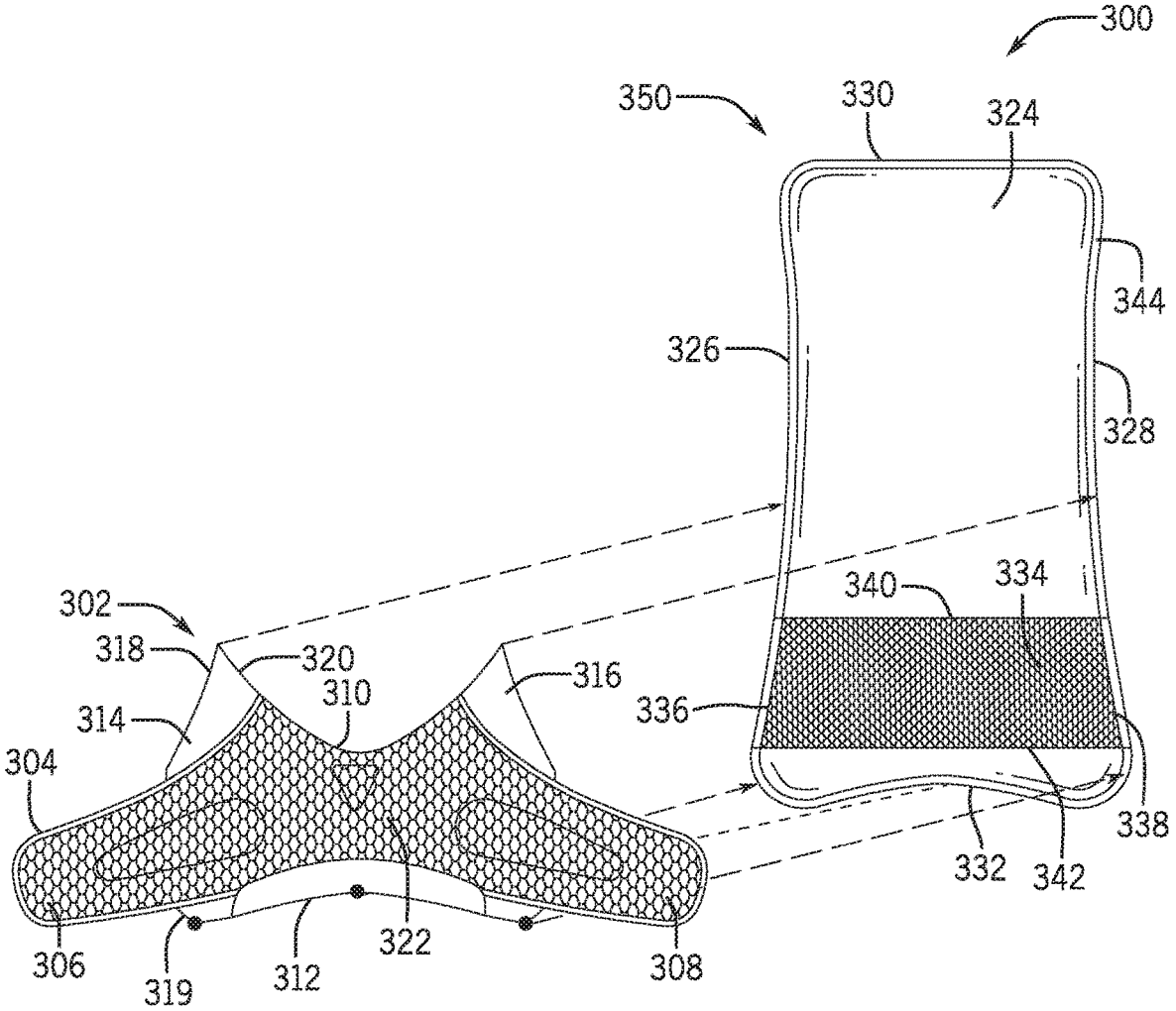
FIG. 4 is a perspective partially exploded view of a backpack frame assembly with a flexible hip belt assembly showing another example of attachment locations therebetween.

Other embodiments for a backpack with a flexible hip belt are envisioned. As shown in the embodiment depicted in FIG. 4, a flexible hip belt assembly 302 may be separate from a frame assembly 350 for a backpack 300. The features in the present embodiment have the same or similar structure and function as described above. In the present embodiment, the flexible hip belt assembly 302 includes a hip belt 304 and two resilient panels 314, 316 attached at opposite lateral sides of the hip belt 304. The flexible hip belt assembly 302 may have four attachment locations. The resilient panels 314, 316 may each attach to the frame assembly 350 at an upper portion and lower portion of each resilient panel 314, 316. In the depicted embodiment, the frame assembly 350 includes a back panel 324, a frame member 344, and a support panel 334. The resilient panels 314, 316 may attach directly to the back panel 324, to the frame member 344, or to both. As shown, the resilient panels 314, 316 may attach at discrete points. A point on the top edge portion 320 of each resilient panel 314, 316 may attach to a point on the lower middle portion of the frame assembly 350, and a point on the bottom edge portion 319 of each resilient panel 314, 316 may attach to a point on the bottom portion of the frame assembly 350. It is also contemplated that the resilient panels 314, 316 may attach to the frame assembly 350 along a continuous edge portion, or along at least a portion of an edge portion, of each resilient panel 314, 316. In this embodiment, the upper edge portion 310 of the hip belt 304 may attach directly to the back panel 324. As another example of the present embodiment, at least a portion of a bottom edge portion 312 of the flexible hip belt assembly 302 may be fixedly attached to the frame assembly 350 to create an anchor for load bearing support.

In an alternate embodiment pertinent to both of the above examples, the resilient panels 118, 120, 314, 316 may be integrated with the frame assembly 102, 350, allowing for a resilient attachment point for hip belts of various shapes and sizes.

In other embodiments, the resilient panels 118, 120 may be in various configurations. For example, the resilient panels 118, 120 may be positioned along at least a portion of the upper edge portion 154 of the hip belt 122. There may be more than two resilient panels 118, 120 or one resilient panel, and the shapes and sizes may vary. For example, a single resilient panel may extend behind the hip belt 122 to both side edge portions 140, 142 of the frame assembly 102.

In additional embodiments, the back panel assembly 104 may include only the back panel 108. In this configuration, the resilient panels 118, 120 may attach directly to the back panel 108 instead of to the suspension panel 110 as depicted in the FIGS. 1-3 and 5.

The backpack 100, 300 may be formed from a variety of materials and means. For example, the frame assembly 102, 350, among others, may be formed from a thermoplastic material (self-reinforced or fiber reinforced), ABS, polycarbonate, polypropylene, polystyrene, PVC, polyamide, and/or PTFE, among others. In some examples, portions of the backpack 100, 300 may be extruded from aluminum or other similar metal. In addition, the frame assembly 102, 350 may be formed from fiber reinforced epoxy, resin, or other similar material. The backpack 100, 300 may be formed or molded in any suitable manner, such as by plug molding, blow molding, injection molding, extrusion, casting, or the like. The various components detailed above may be attached by various means, such as, for example, by stitching or sewing, or other mechanical fastening means; or by adhesive, bonding, sonic welding, heat taping, and other non-mechanical mechanisms to secure items together. The backpack 100, 300 may be formed from soft side material and/or hard side material. Exemplary materials are noted above.

All relative and directional references (including: upper, lower, upward, downward, left, right, leftward, rightward, top, bottom, side, above, below, front, middle, back, vertical, horizontal, and so forth) are given by way of example to aid the reader's understanding of the particular examples described herein. They should not be read to be requirements or limitations, particularly as to the position, orientation, or use unless specifically set forth in the claims. Connection references (e.g., attached, coupled, connected, joined, and the like) are to be construed broadly and may include intermediate members between a connection of elements and relative movement between elements. As such, connection references do not necessarily infer that two elements are directly connected and in fixed relation to each other, unless specifically set forth in the claims.

Those skilled in the art will appreciate that the presently disclosed examples teach by way of example and not by limitation. Therefore, the matter contained in the above description or shown in the accompanying drawings should be interpreted as illustrative and not in a limiting sense. The following claims are intended to cover all generic and specific features described herein, as well as all statements of the scope of the present method and system, which, as a matter of language, might be said to fall there between.

The invention claimed is:

1. A backpack comprising:

a frame assembly;

a hip belt including a central portion, the central portion having opposing first and second arms extending from the central portion, the central portion having opposing lateral portions;

at least one resilient panel connected between the hip belt and the frame assembly, wherein the at least one resilient panel defines opposing upper and lower edge portions, and opposing interior and exterior side edge portions; and said at least one resilient panel expands or contracts as the hip belt and frame assembly move relative to one another to reduce forces applied to the hip belt by non-vertical movement of the frame assembly, wherein a bottom edge portion of the hip belt couples to the frame assembly forming a load bearing seam to support a vertical load applied between the frame assembly and the hip belt.

2. The backpack of claim 1, wherein the at least one resilient panel forms an elongated panel coupling the hip belt to the frame assembly.

3. The backpack of claim 1, wherein the at least one resilient panel comprises two laterally spaced resilient panels each coupled between the frame assembly and the central portion of the hip belt.

4. The backpack of claim 1, wherein the relative movement of the hip belt and the frame assembly is at least one of a rotational motion and a twisting motion.

5. The backpack of claim 1, wherein at least a part of the interior side edge portion of the at least one resilient panel is attached to the hip belt and at least part of at least one of the upper edge portion and exterior side edge portion is attached to the frame assembly.

6. The backpack of claim 1, wherein the frame assembly comprises:

a back panel assembly, wherein the back panel assembly defines opposing first and second side edge portions;

a frame member disposed about a perimeter of the back panel assembly; and wherein the at least part of at least one of the upper edge portion and exterior side edge portion of the at least one resilient panel is attached to at least one of the back panel assembly and the frame member.

7. The backpack of claim 6, wherein the back panel assembly comprises a back panel, wherein the back panel defines opposing first and second side edge portions; and wherein the at least part of at least one of the upper edge portion and exterior side edge portion of the at least one resilient panel is attached to the back panel.

8. The backpack of claim 7, wherein the back panel assembly further comprises a suspension panel coupled to at least an upper portion of the back panel and spaced apart from the back panel, wherein the suspension panel includes a bottom edge portion, and wherein the at least part of at least one of the upper edge portion and exterior side edge portion of the at least one resilient panel is attached to at least one of the back panel and the suspension panel.

9. The backpack of claim 6, wherein an entire length of the exterior side edge portion of the at least one resilient panel is attached to at least one of the back panel assembly and the frame member.

10. The backpack of claim 8, wherein an entire length of the upper edge portion of the at least one resilient panel is attached to at least a portion of the bottom edge portion of the suspension panel.

11. The backpack of claim 1, wherein at least a portion of the interior side edge portion of the at least one resilient panel extends along and is coupled to at least a portion of a height of an adjacent lateral portion of the central portion of the hip belt.

12. The backpack of claim 11, wherein the interior side edge portion extends along and is coupled to the entirety of a height of the adjacent lateral portion of the central portion of the hip belt.

13. The backpack of claim 1, wherein when force is applied to the hip belt, the at least one resilient panel stretches in a direction of the applied force, and when the applied force is removed, the at least one resilient panel returns to an original position.

14. The backpack of claim 1, wherein the at least one resilient panel is directly connected to at least one of the hip belt and the frame assembly.

15. A backpack comprising:

a frame assembly;

a hip belt including a central portion; and at least one resilient member connected between the frame assembly and the hip belt, wherein the at least one resilient member has a length and a width and defines a flat and elongated shape, wherein the at least one resilient member is stretchable along the length and the width, and wherein a bottom edge portion of the hip belt couples to the frame assembly forming a load bearing seam to support a vertical load applied between the frame assembly and the hip belt.

16. The backpack of claim 15, wherein the at least one resilient member comprises two laterally spaced resilient members positioned on opposite sides of the central portion of the hip belt.

17. The backpack of claim 15, wherein the at least one resilient member comprises at least one strap.

18. A backpack comprising:

a hip belt having a top edge portion and at least one side edge portion;

a suspension panel having a bottom portion; and at least one resilient member with a first edge portion and a second edge portion, wherein each edge portion defines a length, wherein the at least one resilient member couples to at least one of the top edge portion and the at least one side edge portion of the hip belt along at least a portion of the length of the first edge portion, and wherein the at least one resilient member couples to the bottom portion of the suspension panel along at least a portion of the length of the second edge portion, and wherein the hip belt has a bottom edge portion and the backpack further comprises a frame assembly, wherein the bottom edge portion of the hip belt is coupled to a bottom portion of the frame assembly forming a load bearing engagement to support a vertical load applied between the frame assembly and the hip belt.

* * * * *